US010197365B1

(12) United States Patent
Blyskal et al.

(10) Patent No.: US 10,197,365 B1
(45) Date of Patent: Feb. 5, 2019

(54) SCALABLE EFFECTS NET WARHEAD

(71) Applicant: The United States of America as Represented by the Secretary of the Army, Washington, DC (US)

(72) Inventors: Tomasz Blyskal, Flemington, NJ (US); Richard Fong, Boonton, NJ (US); LaMar Thompson, Bloomfield, NJ (US)

(73) Assignee: The United States of America as Represented by the Secretary of the Army, Washington, DC (US)

( * ) Notice: Subject to any disclaimer, the term of this patent is extended or adjusted under 35 U.S.C. 154(b) by 0 days.

(21) Appl. No.: 15/788,946

(22) Filed: Oct. 20, 2017

(51) Int. Cl.

| | |
|---|---|
| ***F41H 13/00*** | (2006.01) |
| ***F42B 12/02*** | (2006.01) |
| ***F42B 12/56*** | (2006.01) |
| ***F42B 12/66*** | (2006.01) |
| ***F42B 12/68*** | (2006.01) |

(52) U.S. Cl.
CPC ..... *F41H 13/0006* (2013.01); *F42B 12/02* (2013.01); *F42B 12/56* (2013.01); *F42B 12/66* (2013.01); *F42B 12/68* (2013.01)

(58) Field of Classification Search
CPC ..... F41H 13/00; F41H 13/0006; F42B 12/00; F42B 12/02; F42B 12/205; F42B 12/56; F42B 12/58; F42B 12/60; F42B 12/66; F42B 12/68
USPC ..... 102/501, 502; 89/1.11, 1.14, 1.1
See application file for complete search history.

(56) References Cited

U.S. PATENT DOCUMENTS

| | | | | |
|---|---|---|---|---|
| 2,372,383 | A * | 3/1945 | Lee | F41H 11/04 102/504 |
| 6,626,077 | B1 * | 9/2003 | Gilbert | F41H 13/0006 102/400 |
| 7,028,947 | B2 * | 4/2006 | Burns | B64D 7/00 244/1 TD |
| 7,412,916 | B2 * | 8/2008 | Lloyd | F41H 13/0006 102/473 |
| 7,415,917 | B2 * | 8/2008 | Lloyd | F41H 13/0006 102/293 |
| 8,141,493 | B1 * | 3/2012 | Kuchman | F41H 13/0006 102/439 |
| 8,205,537 | B1 * | 6/2012 | Dupont | F41H 13/0006 102/504 |
| 8,387,507 | B2 * | 3/2013 | Johnson | F41H 11/02 89/1.1 |
| 8,387,540 | B2 * | 3/2013 | Merems | F41H 11/02 102/501 |
| 9,074,858 | B2 * | 7/2015 | Yee | F41H 11/02 |
| 2012/0091252 | A1 * | 4/2012 | Zatterqvist | F41H 11/02 244/3.1 |
| 2016/0376029 | A1 * | 12/2016 | Sekiya | F41H 11/02 244/110 F |

FOREIGN PATENT DOCUMENTS

| | | | | |
|---|---|---|---|---|
| EP | 000872705 | A2 * | 10/1998 | B63G 7/02 |
| FR | 2965908 | B1 * | 2/2017 | F41H 11/02 |

* cited by examiner

*Primary Examiner* — James S Bergin
(74) *Attorney, Agent, or Firm* — Michael C. Sachs

(57) ABSTRACT

A spin launched unmanned aerial system projectile includes a net means for disabling a selected target. The net means includes deployment mechanism and weights attached thereto which are cast at said target through use of an ejection spring means. Centripetal forces on the still spinning petals/weights open the net means as it is cast at the target.

12 Claims, 2 Drawing Sheets

SCALABLE EFFECTS NET WARHEAD

U.S. GOVERNMENT INTEREST

The inventions described herein may be made, used, or licensed by or for the U.S. Government for U.S. Government purposes.

BACKGROUND OF INVENTION

The interception of an enemy target, such as an unmanned aerial system (UAS), has often employed casting of a net to entangle the target. Other targets may include people, vehicles or boats to be ensnared by a net. Simply dropping a net or launching the net at these targets can be risky and ineffective. Both methods are risky either from a delivery standpoint or from a duration standpoint of increased reaction times (in the case of boats). Capturing boats and entangling their propellers with a net is either done by launching a net in the water or by dropping it from an aircraft in the hopes of ensnaring the target. However, in both cases, the net would have to be deployed directly in front of the boat in order to be successful. Given enough room, an incoming boat could easily navigate around a net and escape, or just be missed by the net. Current counter unmanned aerial systems (CUAS) techniques include dragging nets from larger UAS's in the hopes of ensnaring smaller drones inflight. Unfortunately a major flaw in this approach is the need of a well-trained pilot to try to catch a much lighter, faster, more maneuverable UAS. This task is difficult at best. Another technique is to shoot a net at the threat directly from another UAS. However, a drone-mounted net launcher would be too heavy and have a limited range. As a result, it would require the larger, less maneuverable UAS not only to be in close proximity of the threat, but also to be aimed accurately. The problems are compounded when trying to ensnare many, or a swarm of drones, with one net.

The results of initial testing show that the warhead of this invention can be launched (currently in a 40 mm configuration) and can successfully engage a UAS threat. The performance of this invention goes further than any previous system proposed which merely launches a net directly at a UAS.

BRIEF SUMMARY OF INVENTION

This invention utilizes a projectile round, to more rapidly deliver a net precisely right at the target location, as opposed to launching the net from a relatively large distance away from a target. The invention includes a projectile body including a net with weights, deployment petals, an ejection spring and a releasable ogive. The warhead could be launched from any appropriate gun tube using either propellant or compressed air. Upon exiting the barrel, the velocity and spin of the projectile would be specific to the caliber of the round. As the round nears the target, a signal from a control board activates a servo. The servo pulls on a central lock plunger to release a ball lock mechanism. This releases the ogive section, which in turn allows the ejection spring means to eject the petals and weights along with the net stowed there within. Centripetal forces imparted by previous projectile spin would now force the petals outwards. This would open the (still spinning) net which had been ejected in the path of the target.

OBJECTS OF THE INVENTION

Accordingly, it is an object of the invention to provide a projectile to deliver a net precisely at a desired target location, and to cast such net to intercept the target.

Another object of the present invention is to provide a net warhead for a spin launched projectile, which net warhead includes a folded net containing petals and weights, and a spring ejection means for deploying the net in target proximity.

Another object of the present invention is to provide a 40 mm projectile having a net warhead which is signal activated to eject a spinning net in proximity of a target.

It is a further object of the present invention to provide means for ensnaring a moving unmanned aerial vehicle, moving boat or a moving land vehicle by a net cast at such targets wherein the net is delivered by a spinning projectile device having a net warhead.

These and other objects, features and advantages of the invention will become more apparent in view of the within detailed descriptions of the invention, the claims, and in light of the following drawings wherein reference numerals may be reused where appropriate to indicate a correspondence between the referenced items. It should be understood that the sizes and shapes of the different components in the figures may not be in exact proportion and are shown here just for visual clarity and for purposes of explanation. It is also to be understood that the specific embodiments of the present invention that have been described herein are merely illustrative of certain applications of the principles of the present invention. It should further be understood that the geometry, compositions, values, and dimensions of the components described herein can be modified within the scope of the invention and are not generally intended to be exclusive. Numerous other modifications can be made when implementing the invention for a particular environment, without departing from the spirit and scope of the invention.

LIST OF DRAWINGS

DETAILED DESCRIPTION

Figure 1:
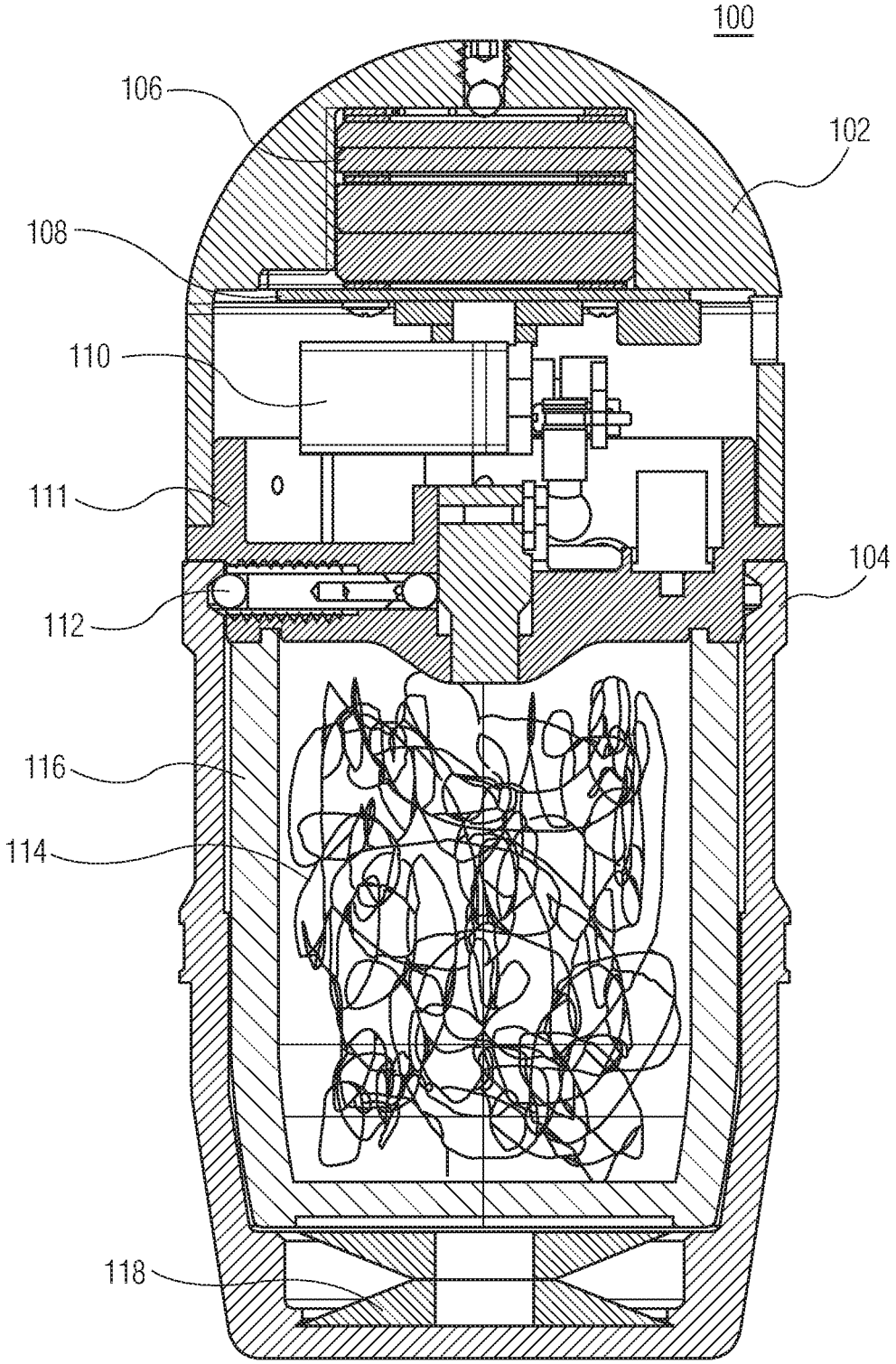
FIG. 1 illustrates a net warhead in a projectile round which may deliver a spinning net at a target location, to ensnare such target, according to this invention.
Figure 2:
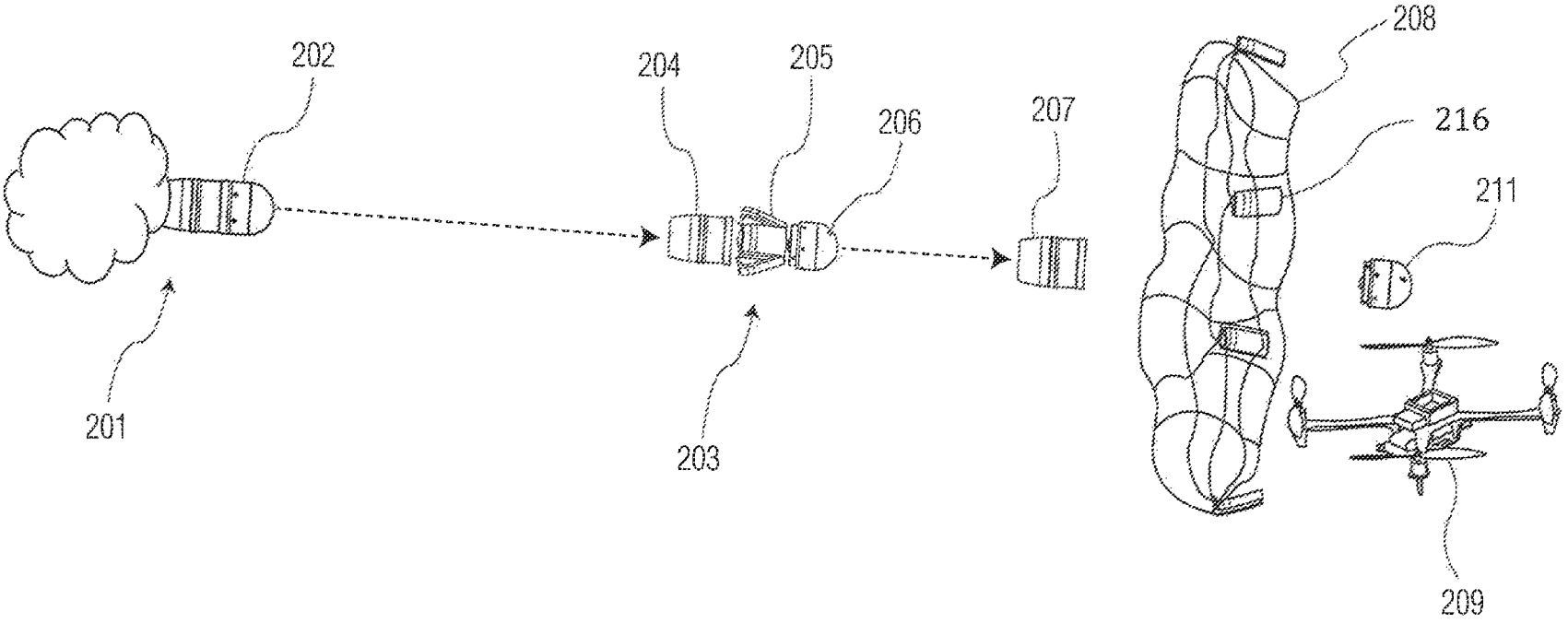
FIG. 2 illustrates the steps of intercepting a targeted device from launch, through spreading net deployment, then through to actual target intercept, according to this invention.

As was mentioned, this invention utilizes a projectile round to more rapidly deliver a net precisely at a target location, as opposed to launching the net from a comparatively large distance away from the target. As shown in FIG. 1, the invention includes a projectile body 104 including a net 114 with weights and deployment petals 116, an ejection spring 118 and a releasable ogive 102. The warhead 100 could be launched from any appropriate gun tube using either propellant or compressed air. Upon exiting the barrel, the velocity and spin of the projectile would be specific to the caliber of the round. As the round nears the target, a signal from an electronics control board 108 activates a release mechanism 110. The signal may be activated remotely or it may be generated locally by encountering proximity to the selected target through a proximity detector means, or both means of activation may be active during an attempted intercept. The release mechanism 110 is a piston actuator moved by a detonated small pyrotechnic charge initiated by the aforementioned signal. Alternately, release mechanism 110 could be an electrical servo device activated by the aforementioned signal. The release mechanism 110 pulls on a central lock release plunger 111 to in turn release a ball lock mechanism 112. This releases the ogive section 102, which in turn allows the ejection spring means 118 to eject the petals and weights along with the net stowed there within. Centripetal forces imparted by previous projectile spin would now force the petals outwards. This would open the (still spinning) net which had been ejected in the path of the target. In FIG. 2, an intercept is attempted of a remote drone 209. In a first step 201, a net warhead 202 in accordance with this invention, is launched. During flight at point 203 being approximately 6 to 9 meters from the target drone, the warhead begins to disassemble. The ogive 206 is released, the ejection means 205 is activated to eject the (already spinning) net assembly 207 out of previously spinning projectile 204. The net assembly 207 has petals and weights 216 which ultimately spread out the still spinning net, as seen in step 208. The net is now fully deployed and hopefully will be able to meet/engage/ensnare, the drone 209. Debris which may be remnants of the ogive and other warhead components may appear as still moving, at 211. Such debris would not be expected to be functional at such point.

While the invention may have been described with reference to certain embodiments, numerous changes, alterations and modifications to the described embodiments are possible without departing from the spirit and scope of the invention as defined in the appended claims, and equivalents thereof.

What is claimed is:

1. A spin launched unmanned aerial system projectile for disabling a selected target, including means for casting a compact, selectively unfoldable net at said target, said projectile including a projectile body, and an ogive section releasably attached at the front of said projectile body, and electrical battery means and a control board aft of said ogive section, and said net includes deployment petals attached to said net, and whereas said means for casting a net at said target includes ejection spring means aft of said net, and whereas a signal from said control board activates a release mechanism which activates a central lock plunger to release a ball lock mechanism to in turn release the ogive section which allows the ejection spring means to eject the petals along with the net stowed therewith, and whereas centripetal forces imparted by previous projectile spin would force the petals outwards, opening the still spinning net which has been ejected in the path of the target.

2. The projectile of claim 1 wherein said control board signal is activated remotely.

3. The projectile of claim 1 wherein said control board signal is generated locally by encountering proximity to the selected target.

4. The projectile of claim 1 wherein control board signals are generated by remote activation of the control board.

5. The projectile of claim 1 wherein the projectile is launched by gas pressure.

6. The projectile of claim 1 wherein the projectile is launched by ignited propellant.

7. The projectile of claim 1 wherein the target is an unmanned aerial system.

8. The projectile of claim 1 wherein the target is a boat.

9. The projectile of claim 1 wherein the target is a boat propeller.

10. The projectile of claim 1 wherein the target is a moving land vehicle.

11. The projectile of claim 1 wherein the target is a stationary land vehicle.

12. The projectile of claim 1 wherein the projectile is a 40 MM.

* * * * *